US005649819A

United States Patent [19]

Karzone

[11] Patent Number: 5,649,819

[45] Date of Patent: Jul. 22, 1997

[54] LOW NOX BURNER HAVING AN IMPROVED REGISTER

[75] Inventor: Samicci A. Karzone, Wichita, Kans.

[73] Assignee: Gordon-Piatt Energy Group, Inc., Winfield, Kans.

[21] Appl. No.: 450,347

[22] Filed: May 25, 1995

[51] Int. Cl.[6] ..... F23C 5/00

[52] U.S. Cl. ..... 431/174; 431/184; 431/284

[58] Field of Search ..... 431/174, 178, 431/181–184, 284, 285

[56] References Cited

U.S. PATENT DOCUMENTS

| | | | |
|---|---|---|---|
| 2,838,103 | 6/1958 | Voorheis | 431/184 |
| 3,003,273 | 5/1961 | Zink, Jr. et al. | 431/174 |
| 3,723,049 | 3/1973 | Juricek | 431/183 |
| 4,201,539 | 5/1980 | Voorheis | 431/354 |
| 4,347,052 | 8/1982 | Reed et al. | 431/188 |
| 4,511,325 | 4/1985 | Voorheis | 431/10 |
| 4,575,332 | 3/1986 | Oppenburg et al. | 431/9 |
| 4,748,919 | 6/1988 | Campobenedetto et al. | 110/264 |
| 4,907,962 | 3/1990 | Azuhata et al. | 431/174 |
| 5,044,932 | 9/1991 | Martin et al. | 431/116 |
| 5,240,410 | 8/1993 | Yang et al. | 431/284 |
| 5,257,927 | 11/1993 | Lang | 431/184 |

*Primary Examiner*—Carroll B. Dority

*Attorney, Agent, or Firm*—Bill D. McCarthy; Randall K. McCarthy; Phillip L. Free, Jr.

[57] ABSTRACT

An improved low $NO_x$ burner for firing fuels such as fuel oil, fuel gas and the like having an improved register which includes primary and secondary registers. The primary and secondary registers each have an annular perforated shield covering primary and secondary air inlets. The annular perforated shields form primary and secondary air equalizers which provide a more uniform distribution of combustion air about the register as the combustion air enters the register through primary and secondary air inlets, increasing regulation of combustion air and reducing flame impingement. Annular primary and secondary dampers adjustably cover the primary and secondary air equalizers to slidably adjust the ratio of primary to secondary air entering the primary and secondary registers through the primary and secondary air inlets.

18 Claims, 3 Drawing Sheets

LOW NOX BURNER HAVING AN IMPROVED REGISTER

BACKGROUND OF THE INVENTION

1. Field of the Invention

The present invention relates to low $NO_x$ burners for firing fuels such as fuel oil, fuel gas and the like. More particularly, but not by way of limitation, the present invention relates to a burner having an improved register which provides increased regulation of primary and secondary combustion air and decreased formation of $NO_x$.

2. Discussion

Nitrogen oxides ($NO_x$) are undesirable by-products of every combustion process. Nitric oxide (NO) and nitrogen dioxide ($NO_2$) are the primary nitrogen oxides formed, with others such as $N_2O_4$, $N_2O$ and $NO_3$ produced in only trace quantities. At the temperatures of most combustion applications, the majority of the nitrogen oxides ($NO_x$) are present as nitric oxide (NO). However, when gases containing nitric oxide (NO) enter the atmosphere, the nitric oxide is converted to nitrogen dioxide ($NO_2$) as the gas cools. Therefore, $NO_x$ emission calculations usually assume all of the $NO_x$ is in the $NO_2$ form because this is the form in the atmosphere.

Nitrogen dioxide ($NO_2$) is a toxic gas that the U.S. Environmental Protection Agency (EPA) has designated as a criteria pollutant because of its adverse effects on human health. Nitrogen oxides ($NO_x$) emitted from stationary combustion sources contribute to acid rain deposition and to the degradation of air quality by reacting with reactive hydrocarbons to form smog. For this reason, the amount of nitrogen oxides present in gases vented to the atmosphere is heavily regulated by various state and federal agencies and improved combustion techniques are constantly being sought.

$NO_x$ is formed from one of three sources in a combustion process: thermal $NO_x$, prompt $NO_x$ and fuel bound $NO_x$. Most $NO_x$ emissions from combustion processes are generated from thermal fixation of nitrogen in the combustion air. The generally accepted mechanism of thermal $NO_x$ formation is described by the Zeldovich equilibrium reactions.

$$N_2+O\cdot \leftrightharpoons NO+N\cdot \quad (1)$$

$$N\cdot+O_2 \leftrightharpoons NO+O\cdot \quad (2)$$

As indicated by the above reactions, thermal $NO_x$ formation requires the dissociation of molecular nitrogen ($N_2$) and molecular oxygen ($O_2$). Due to the stability of these molecules, significant dissociation occurs only at high temperatures.

Prompt $NO_x$ is a lesser known type of $NO_x$ formation. The formation of prompt $NO_x$ is proportional to the number of carbon atoms present in the fuel and has a weak temperature dependence and a short lifetime. Prompt $NO_x$ is only significant in fuel rich flames which inherently produce low $NO_x$ levels. Thus, prompt $NO_x$ is not usually a major contributor to overall $NO_x$ emissions.

Fuel bound $NO_x$ is generated from nitrogen compounds present in incinerated waste or in the fuel itself. A significant portion of the fuel or waste nitrogen is converted to $NO_x$. The rate of conversion is much less than 1/1 however. Yet, as little as 1% conversion produces $NO_x$ concentrations far above regulatory limits. The exact conversion rate is a complex function of stoichiometry, temperature, and the specific nitrogen compound being incinerated; and unfortunately, the detailed mechanisms and kinetics involved in fuel bound $NO_x$ formation are not completely understood.

There have been considerable efforts in the art to reduce ($NO_x$) in combustion gases so that such gases may be discharged to the atmosphere without harm to the environment. These efforts can be grouped into two categories: "combustion control techniques" and "post combustion control techniques." "Post combustion control techniques" are methods to remove the nitrogen oxides in combustion gases after their formation. The most established of such post combustion control techniques are; SNCR Selective Non-Catalytic Reduction; and SNR Selective Catalytic Reduction.

There are two commercially available SNCR systems. One is commonly referred to as Thermal DeNOx and was originally patented by Exxon, U.S. Pat. No. 3,900,554, issued to Lyon. The other SNCR process is commonly called NOxOUT. Both the Thermal DeNOx and NOxOUT processes involve injection of specific nitrogen bearing compounds, such as ammonia and urea, into the combustion products to reduce $NO_x$ produced during combustion Both reduction reactions occur in a specific temperature range.

Various SCR techniques are known as well. In SCR techniques, as with Thermal DeNOx, ammonia is injected to reduce $NO_x$. However, in the SCR processes, the ammonia is injected upstream of a catalyst grid and the catalyst changes the optimum temperature range at which $NO_x$ reduction occurs.

Although post-combustion control techniques, such as SNCR and SCR systems, are often employed to reduce $NO_x$ emissions in combustion gases containing $NO_x$, "combustion control techniques" which prevent the formation of $NO_x$ during the combustion process are more economical methods of meeting $NO_x$ emission requirements. Such combustion control techniques include burner design considerations.

Most modern burner designs rely on the well established technique of recirculation of combustion products back into the flame envelope as a method of $NO_x$ reduction. Many low $NO_x$ burners utilize external recirculation. This technique, called flue gas recirculation (FGR), recycles combustion off-gas into the burner, often after cooling the recirculated flue gas in a heat recovery device. FGR suppresses $NO_x$ formation by lowering the oxygen content in the flame and, more significantly, by lowering the peak flame temperature as a result of the larger mass of gas heated.

Other low $NO_x$ burners achieve similar results using internal recirculation of the products of combustion. Internal recirculation is typically accomplished through a bluff body, swirl vortex, baffle geometry, or toroidal ring. This provides optimum conditions in specific zones of the flame, and the more effectively these conditions are achieved, the more efficient the $NO_x$ reduction.

Still other low $NO_x$ burners function by fuel staging in which a portion of the fuel is mixed with all of the combustion air in the primary combustion zone of the burner. The high level of excess air lowers the peak flame temperature, reducing $NO_x$ formation. Secondary fuel is injected through nozzles located at the perimeter of the burner causing the fuel gas to entrain incinerator gases and mix with the first stage combustion gases. This entrainment of combustion products, as in flue gas recirculation, serves to enhance $NO_x$ reduction from the burner.

The primary combustion control technique, however, is air staging. In this technique, the combustion air is split into two streams. The first portion of combustion air is mixed with the fuel in selected substoichiometric quantities to produce a reducing environment. The second portion of combustion air is injected downstream to complete the combustion. The result is a dual zone combustion process wherein the first zone operates under reducing conditions and the second zone operates under oxidizing conditions.

Many burner design applications operate with combustion air supplied under forced draft conditions. In such a design, a force draft fan supplies air through a set of dampers to a windbox. The dampers help direct the forced draft combustion air toward various regions of the windbox, where air registers distribute the combustion air to the burner as appropriate.

Prior art registers suffer from several drawbacks. Because the forced draft combustion air typically enters the windbox at a selected location on the windbox, prior art registers typically allow the forced draft combustion air to enter the register in an uneven distribution, rather than uniformly around the circumference of the register. In addition, because of the distance between the windbox dampers and the register, zoned registers which are designed to stage combustion air into primary and secondary combustion zones often provide imprecise control over the ratio of primary to secondary combustion air.

Modem low $NO_x$ burner designs generally incorporate one or a combination of the methods and techniques mentioned above to minimize the three factors that contribute to $NO_x$ in combustion systems: (1) flame temperature, (2) residence time of the combustion gases in the high temperature zone and (3) excess oxygen supply. This complex balancing of techniques and variables only serves to intensify the need for greater control over combustion air.

Thus, while there have been considerable efforts to find effective ways to remove or prevent the formation of nitrogen oxides in combustion gases so that the gases can be discharged into the atmosphere without harm to the environment, new and improved devices are constantly being sought which will eliminate the deficiencies of the prior art devices, and which meet the increasingly stringent regulatory requirements placed on combustion gases by federal and state agencies.

SUMMARY OF THE INVENTION

The present invention provides an apparatus for burning fuel having an improved register which provides increased regulation of primary and secondary combustion air and decreased formation of $NO_x$. According to the present invention a first fuel supply means is provided for supplying a controlled amount of fuel along a central axis to an ignition site. A primary register means is concentrically disposed about the first fuel supply means for supplying primary air to the ignition site, wherein the primary register means comprises: a first annular chamber concentrically disposed about the first fuel supply means, the first annular chamber having a primary air inlet; a primary air equalizer means covering the primary air inlet; and a primary air damper means for adjusting the amount of primary air that can enter the first annular chamber through the primary air equalizer. A secondary register means is concentrically disposed about the primary register means for supplying secondary air, wherein the secondary register means comprises: a second annular chamber concentrically disposed about the primary register means, the second annular chamber having an annular secondary air inlet; a secondary air equalizer means covering the secondary air inlet; and a secondary air damper means for adjusting the amount of secondary air that can enter the second annular chamber through the secondary air equalizer.

In the preferred embodiment, the secondary register means further comprises a plurality of blades disposed to impart a vortical flow to the secondary combustion air. Primary and secondary air equalizer means are provided which each comprise an annular perforted shield to distribute the combustion air entering the air inlet more evenly about the circumference of the air inlet. Primary and secondary aid damper means are provided which each include an annular damper to adjust the amount of combustion air entering the air inlet through the air equalizer means and a damper adjustment means for adjusting the damper to regulate the size of the air inlet. A spin diffuser is connected to the first fuel supply means for imparting a vortical flow to at least a portion of the primary air. A second fuel supply means is also provided for supplying a controlled amount of fuel at a plurality of positions concentric with and radially disposed from the first fuel supply means.

An object of the present invention is to provide a fuel burner assembly having an improved register which provides a more uniform distribution of combustion air around the circumference of the register.

Another object of the present invention, while achieving the above stated objects, is to provide a fuel burner assembly having an improved register that allows more precise control of primary and secondary combustion air.

Yet another object of the present invention, while achieving the above stated objects, is to provide a fuel burner assembly which minimizes the formation of nitrogen oxides in combustion gases so that the gases may be discharged into the atmosphere without harm to the environment.

Other objects, features and advantages of the present invention will become clear from the following description when read in conjunction with the drawings and appended claims.

BRIEF DESCRIPTIONS OF THE DRAWINGS

DESCRIPTION

Figure 1:
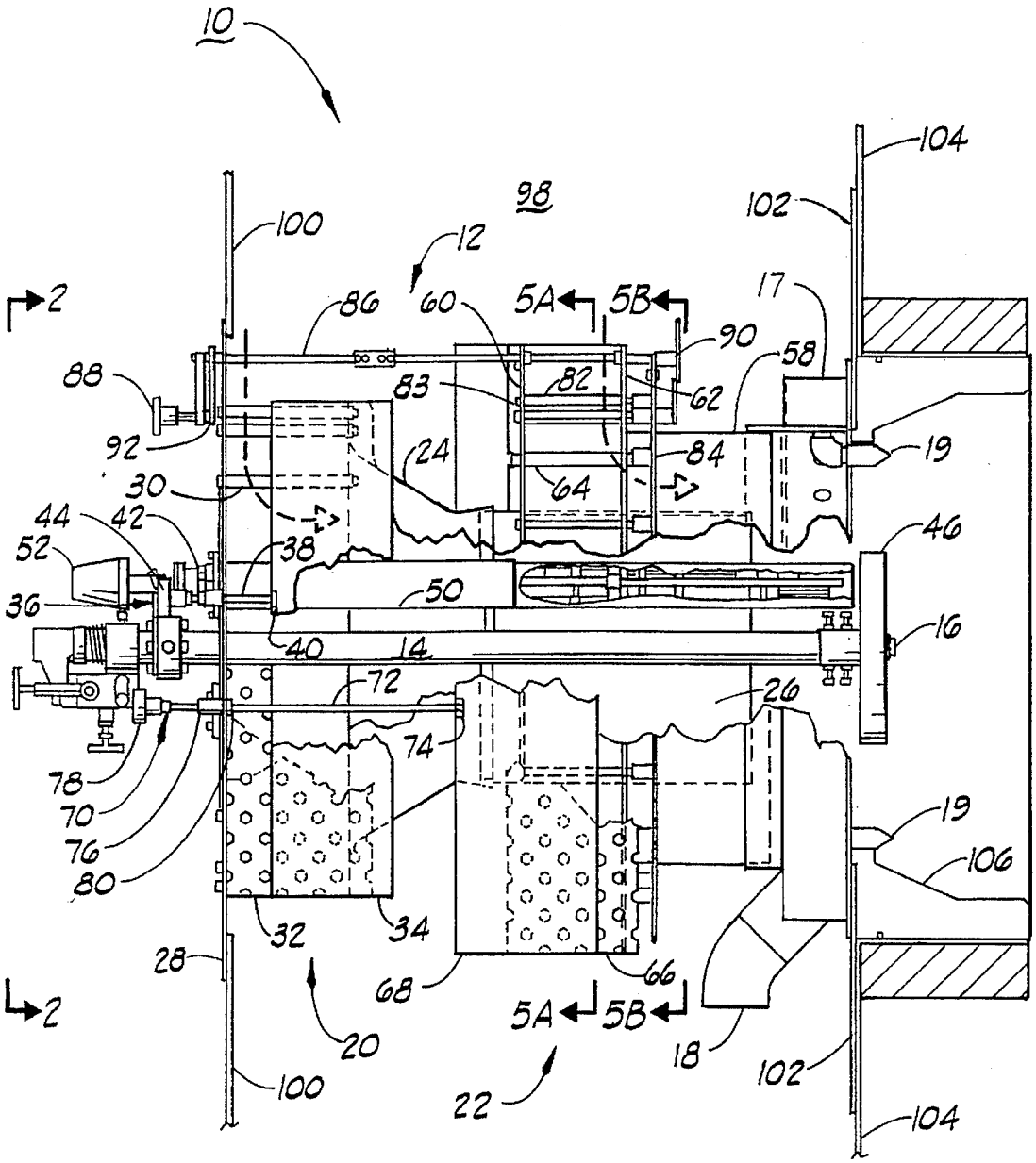
FIG. 1 is a side elevational view in partial cross section of a fuel burner assembly according to the present invention as viewed from inside the windbox.

Referring now to the drawings and, in particular, to FIG. 1, shown therein is one embodiment of the fuel burner assembly of the present invention, indicated generally by the numeral 10. The fuel burner assembly 10 generally comprises an air register assembly 12, and an oil gun 14 which serves as a first fuel supply means for supplying a controlled amount of fuel along the central axis of the fuel burner assembly 10 to an ignition site. A second oil gun (not shown) can optionally be provided alongside the oil gun 14, and the dual oil guns can be provided with a fuel control to permit servicing of the oil guns without shutdown of the fuel burner assembly 10.

The oil gun 14 preferably provides steam atomization for oil firing of No. 2 through No. 6 fuel oils. Atomization of the fuel oil is accomplished by internal action of steam velocities. The fuel oil is dispersed from an oil gun nozzle 16 in a fine spray allowing rapid and efficient combustion, at relatively low pressures. Of course, other atomization techniques can be used, such as air atomization or mechanical pressure atomization.

A gas manifold 17 is provided as a second fuel supply means to allow single fuel, gas or oil firing, as well as combination fuel firing. The gas manifold 17 includes a gas inlet 18 and a plurality of individual gas nozzles 19 which are concentric with and radially disposed from the oil gun nozzle 16. Persons skilled in the art will recognize that the first and second fuel supply means described above are only illustrative and that various others may be substituted for or combined with the described fuel supply means within the scope of the present invention.

The air register assembly 12 according to the present invention includes an annular primary register 20 and a secondary register 22. The primary register 20 forms an inner chamber, or air passage, concentrically disposed about the oil gun 14, the inner chamber defined by a hollow venturi cone 24 connected to a primary air cylinder 26. The venturi cone 24 is attached to a register front plate 28 by a plurality of venturi spacers and bolts 30 such that a primary air inlet to the inner chamber (within the venturi cone 24 and the primary air cylinder 26) is defined between the register front plate 28 and the venturi cone 24.

An annular perforated shield, or primary air equalizer 32, covers the primary air inlet, and causes distribution of primary air evenly around the circumference of the primary register 20 as the primary air enters the primary air inlet. The primary air equalizer 32 allows a regulated amount of primary air to enter the primary air inlet through the perforations or holes therein. However, excess air is deflected toward other areas of the primary air inlet, providing a more uniform distribution of primary air in the inner chamber, thereby decreasing the likelihood of flame impingement.

Figure 2:
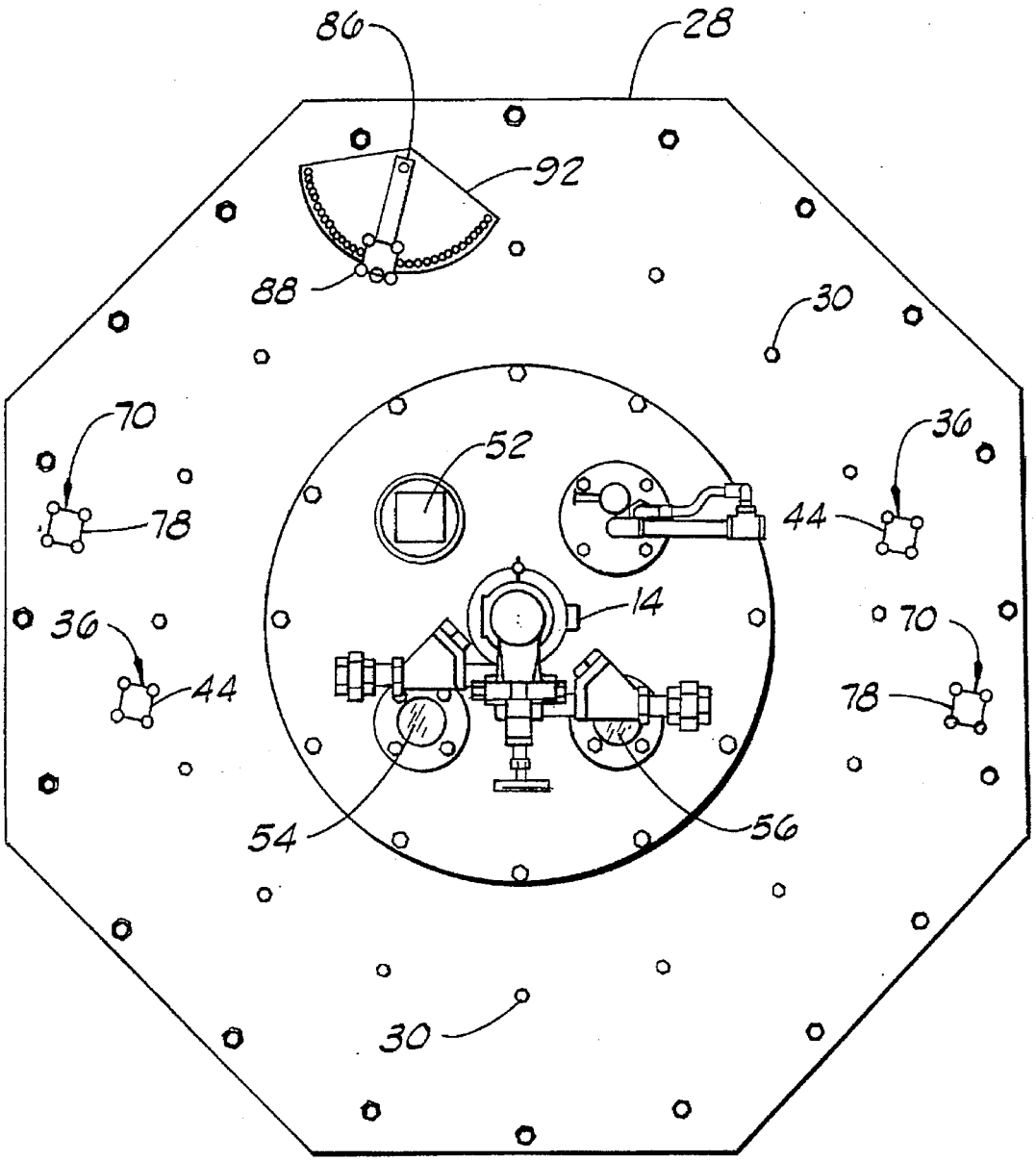
FIG. 2 is an end elevational view along line 2—2 of FIG. 1.

An annular primary air damper 34 is adjustably mounted over the primary air equalizer 32 to selectively block a portion of the perforations, thereby adjusting the amount of primary air permitted to enter the primary air inlet through the primary air inlet through the primary air equalizer 32. As shown in FIGS. 1 and 2, a pair of primary pullrod assemblies 36 are connected to the primary air damper 34. Each primary pullrod assembly 36 has a primary pullrod 38 which is secured at its proximal end to the primary air damper 34 by an annular locking collar 40 which is attached to the primary air damper 34. The annular locking collar 40, which includes a roll pin, receives the proximal end of the primary pullrod 38 and secures it with the roll pin. Each primary pullrod 38 is disposed through the register front plate 28 and is supported at the register front plate 28 by a primary pullrod holder 42 which includes a set screw.

A handle 44 is attached to the distal end of each primary pullrod 38, allowing the burner operator to use the primary pullrod assemblies 36 to slidably adjust the primary air damper 34. Preferably, each primary pullrod 38 has a plurality of scribe lines (not shown) around the circumference of each primary pullrod 38. The scribe lines are equally spaced along the primary pullrod 38 and are consecutively numbered. The scribe lines serve as detents which catch on the register front plate 28 as the burner operator uses the handles 44 to slidably adjust the primary air damper 34. The operator can release the scribe lines on the primary pullrods 38 from the register front plate 28 by lifting slightly on the handles 44. The numbers can be seen by the burner operator near the primary pullrod holder 42 and allow the burner operator to calibrate various desirable settings. The set screw on the primary pullrod holder 42 can be used to lock the primary pullrod assembly 36 at a desired setting.

Figure 3:
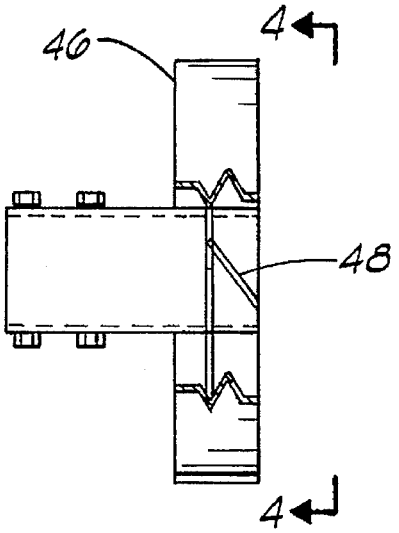
FIG. 3 is a side elevational view of the spin diffuser in partial cross section.
Figure 4:
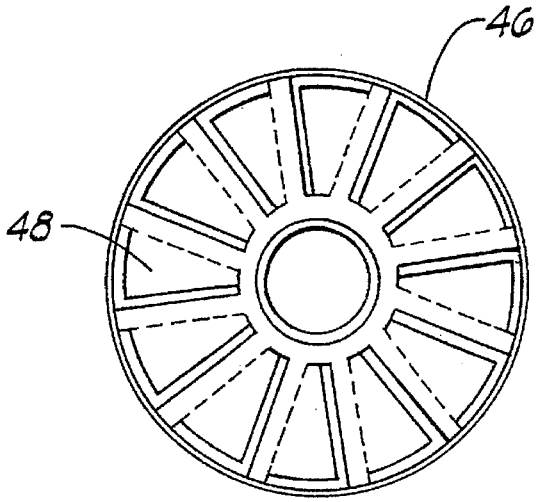
FIG. 4 is an end elevational view of the spin diffuser along line 4—4 of FIG. 3.

The primary register 20 supplies primary combustion air to the ignition site near the oil gun nozzle 16. As shown in FIGS. 1, 3 and 4, a spin diffuser 46 is disposed about the oil gun 14 and includes a plurality of pitched radial blades 48 arranged to create a vortex flow at the point where fuel mixes with the primary combustion air. A pilot assembly 50 is disposed alongside the oil gun 14 and terminates near the ignition site to provide ignition of the fuel and combustion air mixture. Preferably, a flame scanner 52 is attached to the register front plate 28 to provide automatic detection of the presence of a flame. Observation ports 54, 56 can also be provided to allow the burner operator to view the flame.

As depicted in FIG. 1, the secondary register 22 has a secondary air cylinder 58 which defines an outer annular chamber concentrically disposed about the primary register 20. First and second annular plates 60, 62 are offset by a plurality of secondary spacers and bolts 64 and define a secondary air inlet to the outer annular chamber in the secondary air cylinder 58. An annular perforated shield, or secondary air equalizer 66, covers the secondary air inlet, and distributes the secondary air evenly about the circumference of the secondary register 22 as the secondary air enters the secondary air inlet. The secondary air equalizer 66 allows a regulated amount of secondary air to enter the secondary air inlet through the perforations or holes therein. However, excess air is deflected toward other areas of the secondary air inlet, providing a more uniform distribution of secondary air in the outer annular chamber, thereby decreasing the likelihood of flame impingement.

An annular secondary air damper 68 is adjustably mounted over the secondary air equalizer 66 and adjusts the amount of secondary air entering the secondary air inlet through the secondary air equalizer 66. As shown in FIGS. 1 and 2, a pair of secondary pullrod assemblies 70 are connected to the secondary air damper 68. Each secondary pullrod assembly 70 has a secondary pullrod 72 which is secured at its proximal end to the secondary air damper 68 by an annular locking collar 74 which is attached to the secondary air damper 68. The annular locking collar 74, which includes a roll pin, receives the proximal end of the secondary pullrod 72 and secures it with the roll pin. Each secondary pullrod 72 is disposed through the register front plate 28 and is supported at the register front plate 28 by a secondary pullrod holder 76 which includes a set screw.

A handle 78 is attached to the distal end of each secondary pullrod 72, allowing the burner operator to use the secondary pullrod assemblies 70 to slidably adjust the secondary air damper 68. An annular locking collar 80 which includes a roll pin is disposed about each secondary pullrod 72. The roll pin of the locking collar 80 attaches the locking collar 80 securely in place on the secondary pullrod 72 to prevent the secondary air damper 68 from being drawn too far back by the burner operator.

Preferably, each secondary pullrod 72 has a plurality of scribe lines (not shown) around the circumference of each secondary pullrod 72. The scribe lines are equally spaced along the secondary pullrod 72 and are consecutively numbered. The scribe lines serve as detents which catch on the register front plate 28 as the burner operator uses the handles 78 to slidably adjust the secondary air damper 68. The operator can release the scribe lines on the secondary pullrods 72 from the register front plate 28 by lifting slightly on the handles 78. The numbers can be seen by the burner operator near the secondary pullrod holder 76 and allow the burner operator to calibrate various desirable settings. The set screw on the secondary pullrod holder 76 can be used to lock the secondary pullrod assembly 70 at a desired setting.

Figure 5:
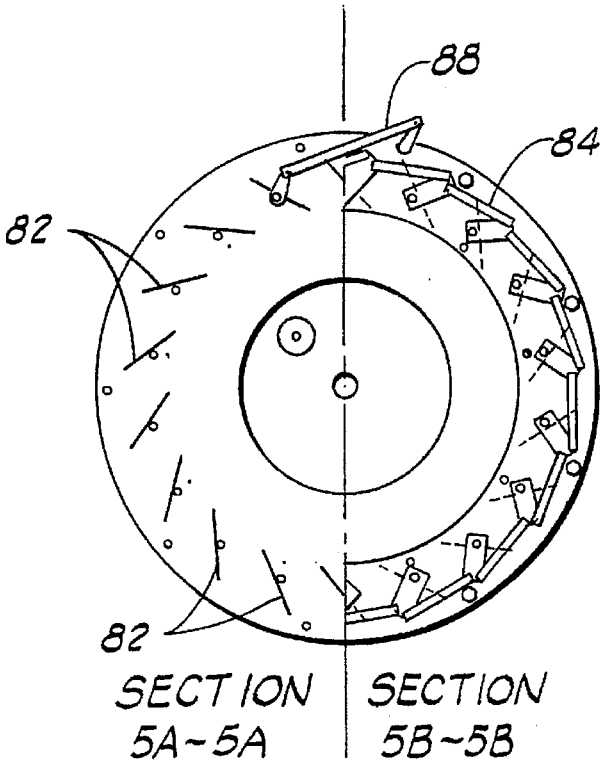
FIG. 5 is a cross sectional view of the secondary register wherein the left half is a sectional view along line 5A–5A' of FIG. 1 and the right half is a sectional view along line 5B–5B' of FIG. 1.

As depicted in FIGS. 1 and 5, a plurality of bi-directional blades 82 are disposed between the first and second annular plates 60, 62 inside the secondary air inlet. The blades 82 are held between the first and second annular plates 60, 62 by shafts 83 which are connected by a linkage 84. The linkage 84 includes an actuating shaft 86 connected to a handle 88 at one end and to an actuator linkage 90 at the other, allowing adjustment of the angle of the blades 82. The blades impart a vortical or swirling flow to the secondary combustion air. Adjustment of the angle of the blades adjusts the degree of swirl imparted to the secondary combustion air.

The blades 82 may also be adjusted between positions which allow either counter-clockwise or clockwise rotation of the secondary combustion air. In addition, the blades 82 may be adjusted so that they form a contiguous annular arrangement, thereby closing the secondary air inlet. As best shown in FIG. 2, a position plate 92 is preferably provided to the register front plate 28 to maintain the handle 88 at selected positions upon adjustment of the blades 82.

Turning now to FIG. 1, in one embodiment the fuel burner assembly 10 of the present invention is mounted inside a conventional windbox 98 which provides a forced draft of combustion air to the air register assembly 12. The combustion air is supplied by a fan (not shown) mounted to the windbox 98 which supplies the combustion air through dampers (not shown) in the top of the windbox 98. Optionally, flue gas can be either recirculated to the fan or introduced through nozzles into the initial stage of combustion to provide additional $NO_x$ reduction. Both of these methods of flue gas recirculation are well known in the art.

The fuel burner assembly 10 is mounted to the windbox 98 by attaching the register front plate 28 to a windbox front plate 100. The gas manifold 17 engages a windbox rear plate 102 which abuts a boiler front plate 104. The boiler front plate 104 has an annular arrangement of refractory tile 106 which defines a throat for the fuel burner assembly 10.

In the operation of the present invention, a forced draft of combustion air is provided to the windbox 98 by a fan (not shown). Dampers (not shown) in the windbox 98 can be used as a rough means of directing a portion of the combustion air toward the primary register 20 and a portion of the combustion air toward the secondary register 22. Because the forced draft of combustion air enters from one location on the windbox 98, the combustion air will not be provided in a uniform distribution about the air register assembly 12.

The primary air equalizer 32 which covers the primary air inlet, and the secondary air equalizer 66 which covers the secondary air inlet serve to distribute the combustion air more uniformly about the primary and secondary registers 20, 22 as the combustion air enters the primary and secondary air inlets. In distributing the primary and secondary combustion air, the primary and secondary air equalizers 32, 66 serve to reduce flame impingement and provide better control over combustion air. Primary and secondary air dampers 34, 68 are independently controlled using primary and secondary pullrod assemblies 36, 70 to adjust the ratio of primary to secondary combustion air that enters the primary and secondary registers 20, 22 through the primary and secondary air inlets.

The primary combustion air (or primary air) enters the primary air inlet into an inner annular chamber defined by the venturi cone 24 and the primary air cylinder 26. The primary air flows through the inner annular chamber and exits near the ignition site. The oil gun 14 disposed along the central axis of the fuel burner assembly 10, supplies a fine mist of oil at the ignition site through the oil gun nozzle 16. The primary air flows through the spin diffuser 46 which imparts a vortical flow to the primary air, which provides for efficient mixing of the fuel and primary combustion air. The pilot assembly 50 provides for ignition of the fuel/air mixture and the spin diffuser 46 creates eddies which stabilizes the base of the resulting flame. As noted above, fuel gas can be provided through the gas inlet 18 to the gas manifold 17, exiting through the gas nozzles 19 for fuel gas firing in place of or in combination with fuel oil firing.

Secondary combustion air (or secondary air) enters the secondary air inlet and is directed in a vortical flow by the blades 82 as it enters the outer annular chamber defined by the secondary air cylinder 58. The secondary air exits the outer annular chamber near the ignition site. The blades 82 can be adjusted to change the degree of swirling of the secondary air to optimize flame shape and fuel/air mixing. The secondary air mixes with the primary combustion air and fuel to complete combustion using a low excess of air and substantially reducing $NO_x$ formation.

It will be clear that the present invention is well adapted to carry out the objects and attain the advantages mentioned as well as those inherent therein. While presently preferred embodiments of the invention have been described for purposes of this disclosure, numerous changes can be made which will readily suggest themselves to those skilled in the art and which are encompassed within the spirit of the invention disclosed and as defined in the appended claims.

What is claimed is:

1. An air register for use with a fuel burner comprising:

primary register means for supplying primary air to an ignition site, the primary register means comprising:

a first chamber having a primary air inlet;

primary air equalizer means including an annular plate having a plurality of openings extending over the primary air inlet for distributing the primary air uniformly about the primary inlet; and primary air damper means for adjusting the amount of primary air that can enter the first chamber through the primary air equalizer by controlling the number of openings of the primary equalizer means accessible to the entry of primary air; and secondary register means for supplying secondary air, the secondary register means comprising:

a second annular chamber concentrically disposed about the primary register means, the second annular chamber having an annular secondary air inlet;

secondary air equalizer means covering the secondary air inlet; and secondary air damper means for adjusting the amount of secondary air that can enter the second annular chamber through the secondary air equalizer means.

2. An air register for use with a fuel burner comprising:

primary register means for supplying primary air to an ignition site, the primary register means comprising:

a first chamber having a primary air inlet;

primary air equalizer means covering the primary air inlet for distributing the primary air uniformly about the primary inlet; and primary air damper means for adjusting the amount of primary air that can enter the first chamber through the primary air equalizer; and secondary register means for supplying secondary air, the secondary register means comprising:

a second annular chamber concentrically disposed about the primary register means, the second annular chamber having an annular secondary air inlet;

secondary air equalizer means covering the secondary air inlet; and secondary air damper means for adjusting the amount of secondary air that can enter the second annular chamber through the secondary air equalizer means, the secondary register means further comprising a plurality of blades disposed to impart a vortical flow to the secondary air.

3. The apparatus of claim 2 wherein the secondary air equalizer means comprises:

an annular perforated shield to distribute the secondary air entering the secondary air inlet more evenly about the circumference of the secondary air inlet.

4. The apparatus of claim 3 wherein the primary air equalizer means comprises:

an annular perforated shield to distribute the primary air entering the primary air inlet more evenly about the circumference of the primary air inlet.

5. The apparatus of claim 4 wherein the primary air damper means comprises:

an annular first damper to adjust the amount of primary air entering the primary air inlet through the primary air equalizer means; and a first damper adjustment means for adjusting the first damper to regulate the size of the primary air inlet.

6. The apparatus of claim 5 wherein the secondary air damper means comprises:

an annular second damper to adjust the amount of secondary air entering the secondary air inlet through the secondary air equalizer means; and a second damper adjustment means for adjusting the second damper to regulate the size of the secondary air inlet.

7. The apparatus of claim 6 further comprising:

spin diffuser means for imparting a vortical flow to at least a portion of the primary air.

8. The apparatus of claim 7 wherein the first annular chamber comprises a venturi cone.

9. The apparatus of claim 8 wherein the plurality of blades are adjustable to regulate the degree and direction of rotation of the secondary air.

10. Apparatus for burning fuel comprising:

a first fuel supply means for supplying a controlled amount of fuel along a central axis to an ignition site;

primary register means concentrically disposed about the first fuel supply means for supplying primary air to the ignition site, wherein the primary register means comprises:

a first chamber concentrically disposed about the first fuel supply means, the first chamber having a primary air inlet for distributing the primary air uniformly about the primary air inlet;

primary air equalizer means covering the primary air inlet; and primary air damper means for adjusting the amount of primary air that can enter the first chamber through the primary air equalizer means; and secondary register means concentrically disposed about the primary register means for supplying secondary air, wherein the secondary register means comprises:

a second annular chamber concentrically disposed about the primary register means, the second annular chamber having an annular secondary air inlet;

secondary air equalizer means covering the secondary air inlet for distributing the secondary air uniformly about the secondary air inlet; and secondary air damper means for adjusting the amount of secondary air that can enter the second annular chamber through the secondary air equalizer means, the secondary register means further comprising a plurality of blades disposed to impart a vortical flow to the secondary air.

11. The apparatus of claim 10 wherein the secondary air equalizer means comprises:

a perforated shield to distribute the secondary air entering the secondary air inlet more evenly about the circumference of the secondary air inlet.

12. The apparatus of claim 11 wherein the primary air equalizer means comprises:

a perforated shield to distribute the primary air entering the primary air inlet more evenly about the circumference of the primary air inlet.

13. The apparatus of claim 12 wherein the primary air damper means comprises:

a first damper to adjust the amount of primary air entering the primary air inlet through the primary air equalizer means; and a first damper adjustment means for adjusting the first damper to regulate the size of the primary air inlet.

14. The apparatus of claim 13 wherein the secondary air damper means comprises:

a second damper to adjust the amount of secondary air entering the secondary air inlet through the secondary air equalizer means; and a second damper adjustment means for adjusting the second damper to regulate the size of the secondary air inlet.

15. The apparatus of claim 14 further comprising:

a spin diffuser connected to the first fuel supply means near the ignition site for imparting a vortical flow to at least a portion of the primary air.

16. The apparatus of claim 15 wherein the first chamber comprises a venturi cone.

17. The apparatus of claim 16 wherein the plurality of blades are adjustable to regulate the degree and direction of rotation of the secondary air.

18. The apparatus of claim 17 further comprising:

a second fuel supply means for supplying a controlled amount of fuel at a plurality of positions concentric with and radially disposed from the first fuel supply means.

* * * * *

UNITED STATES PATENT AND TRADEMARK OFFICE

CERTIFICATE OF CORRECTION

PATENT NO. : 5,649,819

DATED : July 22, 1997

INVENTOR(S) : Samicci A. Karzone

It is certified that error appears in the above-identified patent and that said Letters Patent is hereby corrected as shown below:

On the cover page of patent, references cited:

"3,003,273 5/1961" should read -- 3,033,273 5/1962 --

Column 2, line 19, insert --.-- between the words "combustion" and "Both".

Column 3, line 6, delete the word "force" and insert the word --forced--.

Column 4, line 46, delete "5A-5A'" and insert "5A-5A".

Column 4, line 47, delete "5B-5B'" and insert "5B-5B".

Column 9, line 14, delete the words "an annular" and insert the word --a--.

Column 9, line 19, delete the words "an annular" and insert the word --a--.

Column 9, line 24, delete the words "an annular" and insert the word --a--.

UNITED STATES PATENT AND TRADEMARK OFFICE

CERTIFICATE OF CORRECTION

PATENT NO. : 5,649,819

DATED : July 22, 1997

INVENTOR(S) : Samicci A. Karzone

It is certified that error appears in the above-identified patent and that said Letters Patent is hereby corrected as shown below:

Column 9, line 32, delete the words "an annular" and insert the word --a--.

Column 9, line 41, delete the word "annular".

Signed and Sealed this

Thirty-first Day of March, 1998

*Attest:*

*Attesting Officer*

BRUCE LEHMAN

*Commissioner of Patents and Trademarks*